US012193471B2

(12) United States Patent
Cabot

(10) Patent No.: US 12,193,471 B2
(45) Date of Patent: Jan. 14, 2025

(54) AEROSOLIZABLE FORMULATION

(71) Applicant: NICOVENTURES TRADING LIMITED, London (GB)

(72) Inventor: Ross Cabot, London (GB)

(73) Assignee: Nicoventures Trading Limited, London (GB)

( * ) Notice: Subject to any disclaimer, the term of this patent is extended or adjusted under 35 U.S.C. 154(b) by 510 days.

(21) Appl. No.: 17/290,326

(22) PCT Filed: Oct. 31, 2019

(86) PCT No.: PCT/GB2019/053089
§ 371 (c)(1),
(2) Date: Apr. 30, 2021

(87) PCT Pub. No.: WO2020/089635
PCT Pub. Date: May 7, 2020

(65) Prior Publication Data

US 2023/0165299 A1 Jun. 1, 2023

(30) Foreign Application Priority Data

Nov. 1, 2018 (GB) ..... 1817862

(51) Int. Cl.
*A24B 15/167* (2020.01)
*A24B 15/24* (2006.01)
(Continued)

(52) U.S. Cl.
CPC ..... *A24B 15/167* (2016.11); *A24B 15/243* (2013.01); *A24B 15/283* (2013.01); *A24F 40/10* (2020.01)

(58) Field of Classification Search
CPC .... A61K 9/007; A24B 15/167; A24B 15/243; A24B 15/283
See application file for complete search history.

(56) References Cited

U.S. PATENT DOCUMENTS 5,144,964 A 9/1992 Demain
9,585,835 B1 3/2017 Stenzler et al.
(Continued)

FOREIGN PATENT DOCUMENTS

CN 1607950 A 4/2005
CN 101390659 A 3/2009
(Continued)

OTHER PUBLICATIONS

Decision of Rejection for Chinese Patent Application No. 201980075371.7, mailed on Mar. 24, 2023, 9 pages (7 pages of English Translation and 2 pages of Official Copy).
(Continued)

*Primary Examiner* — Christopher M Rodd
*Assistant Examiner* — Ronnie Kirby Jordan
(74) *Attorney, Agent, or Firm* — WOMBLE BOND DICKINSON (US) LLP; Flynt Strean; Mark DeLuca

(57) ABSTRACT

An aerosolized formulation comprising a vapor phase and a liquid water droplet phase, wherein the aerosolized formulation comprises (i) water in an amount of at least 50 wt. % based on the aerosolized formulation; (ii) one or more flavors; and (iii) nicotine; wherein at least 50 wt. % of the one or more flavors is present in the vapor phase. A process for forming an aerosol comprising a vapor phase and a liquid water droplet phase, an electronic aerosol provision system having an aerosolizer for aerosolizing the aerosolizable formulation for inhalation by a user, and a process for improving delivery of flavor to an aerosolized formulation.

23 Claims, 1 Drawing Sheet

(51) Int. Cl.

| | |
|---|---|
| ***A24B 15/28*** | (2006.01) |
| ***A24F 40/10*** | (2020.01) |

(56) References Cited

U.S. PATENT DOCUMENTS

| | | | | |
|---|---|---|---|---|
| 11,044,937 | B2 | 6/2021 | McAdam et al. | |
| 11,202,465 | B2 | 12/2021 | Inagaki | |
| 2004/0129280 | A1 | 7/2004 | Woodson et al. | |
| 2005/0241656 | A1* | 11/2005 | Kennison | A24F 1/22 131/274 |
| 2007/0003502 | A1* | 1/2007 | Tanabe et al. | A61K 31/048 424/70 |
| 2016/0198759 | A1* | 7/2016 | Kuntawala et al. | A24B 15/16 |
| 2016/0338407 | A1 | 11/2016 | Kerdemelidis | |
| 2017/0119040 | A1 | 5/2017 | Cameron | |
| 2017/0181475 | A1 | 6/2017 | Cameron | |
| 2017/0280767 | A1 | 10/2017 | Li et al. | |
| 2017/0303594 | A1 | 10/2017 | Cameron et al. | |
| 2017/0325494 | A1* | 11/2017 | Cameron et al. | A24B 15/167 |
| 2020/0345059 | A1* | 11/2020 | Mathie et al. | A24B 15/167 |

FOREIGN PATENT DOCUMENTS

| | | | |
|---|---|---|---|
| CN | 102548431 | A | 7/2012 |
| CN | 105581378 | A | 5/2016 |
| DE | 102015117811 | A1 | 4/2017 |
| EP | 2842640 | A1 | 3/2015 |
| EP | 3703518 | A1 | 9/2020 |
| JP | 2006509508 | A | 3/2006 |
| JP | 2008518614 | A | 6/2008 |
| JP | 2016526873 | A | 9/2016 |
| JP | 2017523785 | A | 8/2017 |
| JP | 2017537634 | A | 12/2017 |
| JP | 2018529338 | A | 10/2018 |
| KR | 20160008271 | A | 1/2016 |
| RU | 2279871 | C2 | 7/2006 |
| RU | 2655188 | C2 | 5/2018 |
| WO | 03055486 | A1 | 7/2003 |
| WO | 2004052128 | A2 | 6/2004 |
| WO | 2006048774 | A1 | 5/2006 |
| WO | 2011045609 | A1 | 4/2011 |
| WO | 2013161987 | A1 | 10/2013 |
| WO | WO2014125340 | | 8/2014 |
| WO | 2014187770 | A2 | 11/2014 |
| WO | 2015177252 | A1 | 11/2015 |
| WO | 2016020675 | A1 | 2/2016 |
| WO | 2016096745 | A1 | 6/2016 |
| WO | 2016115250 | A1 | 7/2016 |
| WO | 2017055456 | A1 | 4/2017 |
| WO | 2017175218 | A2 | 10/2017 |

OTHER PUBLICATIONS

Office Action received for European Patent Application No. 19798363.8, mailed on Feb. 28, 2023, 6 pages.

Office Action received for Japanese Patent Application No. 2021-523267, mailed on Mar. 14, 2023, 8 pages (4 pages of English Translation and 4 pages of Official Copy).

Written Opinion received for PCT Patent Application No. PCT/GB2019/053089, mailed on Oct. 12, 2020, 5 pages.

Donglai et al., "Electronic Cigarette", Yunnan University Press, 2015, 7 pages (4 pages of English Translation and 3 pages of Official Copy).

British and European Pharmacopoeia 6.0, "2.9.31 Particle Size Analysis by Laser Light Diffraction," British Pharmacopoeia Commission (2014), Stationery Office and Council of Europe (2013), pp. 311-314.

Clayton P.M., et al., "Spectroscopic Investigations into the Acid-Base Properties of Nicotine at Different Temperatures," Analytical Methods, 2013, vol. 5, pp. 81-88.

First Office Action and Search Report for Chinese Patent Application No. 201980075371.7, mailed on Mar. 3, 2022, 21 pages.

International Preliminary Report on Patentability for Application No. PCT/GB2019/053089, mailed on Feb. 4, 2021, 11 pages.

Office Action for Japanese Application No. 2021-523267, mailed on Aug. 30, 2022, 12 pages.

Search Report for Russian Application No. 2021112014, mailed Dec. 27, 2021, 2 pages.

International Search Report and Written Opinion for PCT/GB2019/053089 date mailed Jan. 21, 2020.

R.R Baker, Smoke Chemistry in Tobacco: Production, Chemistry and Technology, ed. D.L. Davis and M.T. Neilson, Blackwell Science, Great Britain, 1999, ch. 12, p. 399.

Reconsideration Report by Examiner before Appeal, Japanese Patent Application No. 2021-523267, issued Mar. 27, 2024.

* cited by examiner

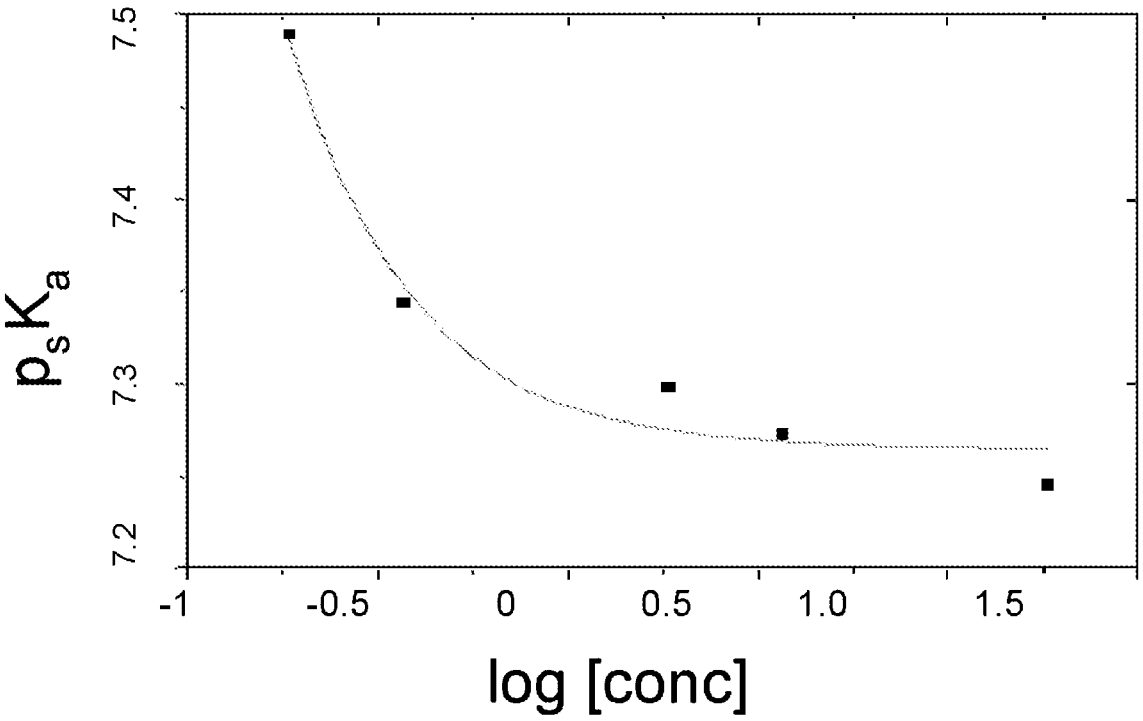
7.5
7.4
7.3
7.2
$p_sK_a$
-1
-0.5
0
0.5
1.0
1.5
log [conc]

AEROSOLIZABLE FORMULATION

PRIORITY CLAIM

The present application is a National Phase entry of PCT Application No. PCT/GB2019/053089, filed Oct. 31, 2019 which claims priority from GB Patent Application No. 1817862.4 filed Nov. 1, 2018, each of which is hereby fully incorporated herein by reference.

FIELD OF THE INVENTION

The present disclosure relates to an aerosolizable formulation, a method of forming the same, a container containing the same, a device containing the same and processes and uses of the same.

BACKGROUND TO THE INVENTION

Electronic aerosol provision systems such as e-cigarettes generally contain a reservoir of liquid which is to be vaporized, typically containing nicotine. When a user inhales on the device, a heater is activated to vaporize a small amount of liquid, which is therefore inhaled by the user.

The use of e-cigarettes in the UK has grown rapidly, and it has been estimated that there are now over a million people using them in the UK.

One challenge faced in providing such systems is to provide from the aerosol provision device an aerosol to be inhaled which provides consumers with an acceptable experience. Some consumers may prefer an e-cigarette that generates an aerosol that closely 'mimics' smoke inhaled from a tobacco product such as a cigarette. Aerosols from e-cigarettes and smoke from tobacco products such as cigarettes provides to the user a complex chain of flavor in the mouth, nicotine absorption in the mouth and throat, followed by nicotine absorption in the lungs. These various aspects are described by users in terms of flavor, intensity/quality, impact, irritation/smoothness and nicotine reward. Nicotine contributes to a number of these factors, and is strongly associated with factors such as impact, irritation and smoothness; these are readily perceived by consumers, and e-cigarettes may offer too much or too little of these parameters for consumers, depending upon individual preferences. Nicotine reward is particularly complex as it results from both the amount of and speed with which nicotine is absorbed from the lining of the mouth, this is typically nicotine in the vapor phase, and from the amount and speed nicotine that is absorbed from the lungs, this is typically nicotine in the particulate phase of the aerosol which is inhaled. Each of these factors, and their balance, can strongly contribute to consumer acceptability of an e-cigarette. Providing means to optimize the overall vaping experience is therefore desirable to e-cigarette manufacturers.

A further challenge facing such systems is the continued demand for harm reduction. Harm from cigarette and e-cigarette devices primarily comes from toxicants. Therefore, there is a desire to reduce or remove the components which may form toxicants.

SUMMARY OF THE INVENTION

In one aspect there is provided an aerosolized formulation comprising a vapor phase and a liquid water droplet phase, wherein the aerosolized formulation comprises (i) water in an amount of at least 50 wt. % based on the aerosolized formulation;
(ii) one or more flavors; and
(iii) nicotine;

wherein at least 50 wt. % of the one or more flavors is present in the vapor phase.

In one aspect there is provided a process for forming an aerosol, the process comprising aerosolizing an aerosolizable formulation comprising (i) water in an amount of at least 50 wt. % based on the aerosolized formulation;
(ii) one or more flavors; and
(iii) nicotine;

to provide an aerosol comprising a vapor phase and a liquid water droplet phase, wherein at least 50 wt. % of the one or more flavors is present in the vapor phase.

In one aspect there is provided an electronic aerosol provision system comprising:

(a) an aerosolizer for aerosolizing formulation for inhalation by a user of the electronic aerosol provision system;
(b) a power supply comprising a cell or battery for supplying power to the aerosolizer;
(c) aerosolizable formulation comprising
  (i) water in an amount of at least 50 wt. % based on the aerosolized formulation;
  (ii) one or more flavors; and
  (iii) nicotine;

wherein the aerosolizer provides an aerosol comprising a vapor phase and a liquid water droplet phase, wherein at least 50 wt. % of the one or more flavors is present in the vapor phase.

In one aspect there is provided a process for improving delivery of flavor to an aerosolized formulation, the process comprising the steps of (a) providing an aerosolizable composition comprising
  (i) water in an amount of at least 50 wt. % based on the aerosolized formulation;
  (ii) one or more flavors; and
  (iii) nicotine;
(b) aerosolizing the aerosolizable composition to provide an aerosol comprising a vapor phase and a liquid water droplet phase, wherein at least 50 wt. % of the one or more flavors is present in the vapor phase.

BRIEF DESCRIPTION OF THE DRAWINGS

The present disclosure will now be described in further detail by way of example only with reference to the accompanying figures in which:

The drawing shows a graph illustrating variation of $p_sK_{a2}$ with nicotine

DETAILED DESCRIPTION

As discussed herein in one aspect there is provided aerosolized formulation comprising a vapor phase and a liquid water droplet phase, wherein the aerosolized formulation comprises (i) water in an amount of at least 50 wt. % based on the aerosolized formulation; (ii) one or more flavors; and (iii) nicotine; wherein at least 50 wt. % of the one or more flavors is present in the vapor phase.

We have found that an advantageous system may be provided which an aerosolized formulation containing a high content of water, a flavor and nicotine is formed from an aerosolizable formulation. The use of a system containing at least 50 wt % water allows for the preferential delivery of flavors in the vapor phase, and in particular delivery of at least 50 wt. % of the one or more flavors in the vapor phase. The use of a system containing at least 50 wt % water allows for the preferential delivery of nicotine in the liquid water droplet phase, and in particular delivery of at least 50 wt. % of the nicotine in the liquid water droplet phase. Furthermore, the use of a system containing at least 50 wt % water 'protects' the flavor from degradation and in particular allows for the formation of an aerosolized formulation at a low temperature. This is in contrast to 'traditional' e-cigarettes which use a heater, typically applied to liquids based on glycerol and propylene glycol to form an aerosolized formulation.

For ease of reference, these and further aspects of the present invention are now discussed under appropriate section headings. However, the teachings under each section are not necessarily limited to each particular section.

Water

As discussed herein the aerosolized formulation comprises water in an amount of at least 50 wt. % based on the aerosolized formulation. In one aspect water is present in an amount of at least 55 wt. % based on the aerosolized formulation. In one aspect water is present in an amount of at least 60 wt. % based on the aerosolized formulation. In one aspect water is present in an amount of at least 65 wt. % based on the aerosolized formulation. In one aspect water is present in an amount of at least 70 wt. % based on the aerosolized formulation. In one aspect water is present in an amount of at least 75 wt. % based on the aerosolized formulation. In one aspect water is present in an amount of at least 80 wt. % based on the aerosolized formulation. In one aspect water is present in an amount of at least 85 wt. % based on the aerosolized formulation. In one aspect water is present in an amount of at least 90 wt. % based on the aerosolized formulation. In one aspect water is present in an amount of at least 95 wt. % based on the aerosolized formulation. In one aspect water is present in an amount of at least 99 wt. % based on the aerosolized formulation.

In one aspect water is present in an amount of from 50 to 99 wt. % based on the aerosolized formulation. In one aspect water is present in an amount of from 55 to 99 wt. % based on the aerosolized formulation. In one aspect water is present in an amount of from 60 to 99 wt. % based on the aerosolized formulation. In one aspect water is present in an amount of from 65 to 99 wt. % based on the aerosolized formulation. In one aspect water is present in an amount of from 70 to 99 wt. % based on the aerosolized formulation. In one aspect water is present in an amount of from 75 to 99 wt. % based on the aerosolized formulation. In one aspect water is present in an amount of from 80 to 99 wt. % based on the aerosolized formulation. In one aspect water is present in an amount of from 85 to 99 wt. % based on the aerosolized formulation. In one aspect water is present in an amount of from 90 to 99 wt. % based on the aerosolized formulation. In one aspect water is present in an amount of from 95 to 99 wt. % based on the aerosolized formulation.

As discussed herein the aerosolizable formulation comprises water in an amount of at least 50 wt. % based on the aerosolizable formulation. In one aspect water is present in an amount of at least 55 wt. % based on the aerosolizable formulation. In one aspect water is present in an amount of at least 60 wt. % based on the aerosolizable formulation. In one aspect water is present in an amount of at least 65 wt. % based on the aerosolizable formulation. In one aspect water is present in an amount of at least 70 wt. % based on the aerosolizable formulation. In one aspect water is present in an amount of at least 75 wt. % based on the aerosolizable formulation. In one aspect water is present in an amount of at least 80 wt. % based on the aerosolizable formulation. In one aspect water is present in an amount of at least 85 wt. % based on the aerosolizable formulation. In one aspect water is present in an amount of at least 90 wt. % based on the aerosolizable formulation. In one aspect water is present in an amount of at least 95 wt. % based on the aerosolizable formulation. In one aspect water is present in an amount of at least 99 wt. % based on the aerosolizable formulation.

In one aspect water is present in an amount of from 50 to 99 wt. % based on the aerosolizable formulation. In one aspect water is present in an amount of from 55 to 99 wt. % based on the aerosolizable formulation. In one aspect water is present in an amount of from 60 to 99 wt. % based on the aerosolizable formulation. In one aspect water is present in an amount of from 65 to 99 wt. % based on the aerosolizable formulation. In one aspect water is present in an amount of from 70 to 99 wt. % based on the aerosolizable formulation. In one aspect water is present in an amount of from 75 to 99 wt. % based on the aerosolizable formulation. In one aspect water is present in an amount of from 80 to 99 wt. % based on the aerosolizable formulation. In one aspect water is present in an amount of from 85 to 99 wt. % based on the aerosolizable formulation. In one aspect water is present in an amount of from 90 to 99 wt. % based on the aerosolizable formulation. In one aspect water is present in an amount of from 95 to 99 wt. % based on the aerosolizable formulation.

As discussed herein the use of water allows for the replacement of some or all of the glycerol, propylene glycol, 1,3-propane diol and mixtures thereof typically used in e-cigarettes. In one aspect the aerosolizable formulation contains glycerol, propylene glycol, 1,3-propane diol and mixtures thereof in a combined amount of no greater than 10 wt. % based on the aerosolizable formulation or based on the aerosolized formulation. In one aspect the aerosolizable formulation contains glycerol, propylene glycol, 1,3-propane diol and mixtures thereof in a combined amount of no greater than 8 wt. % based on the aerosolizable formulation or based on the aerosolized formulation. In one aspect the aerosolizable formulation contains glycerol, propylene glycol, 1,3-propane diol and mixtures thereof in a combined amount of no greater than 5 wt. % based on the aerosolizable formulation or based on the aerosolized formulation. In one aspect the aerosolizable formulation contains glycerol, propylene glycol, 1,3-propane diol and mixtures thereof in a combined amount of no greater than 2 wt. % based on the aerosolizable formulation or based on the aerosolized formulation. In one aspect the aerosolizable formulation contains glycerol, propylene glycol, 1,3-propane diol and mixtures thereof in a combined amount of no greater than 1 wt. % based on the aerosolizable formulation or based on the aerosolized formulation. In one aspect the aerosolizable formulation contains glycerol, propylene glycol, 1,3-propane diol and mixtures thereof in a combined amount of no greater than 0.5 wt. % based on the aerosolizable formulation or based on the aerosolized formulation. In one aspect the aerosolizable formulation contains glycerol, propylene glycol, 1,3-propane diol and mixtures thereof in a combined amount of no greater than 0.2 wt. % based on the aerosolizable formulation or based on the aerosolized formulation. In one aspect the aerosolizable formulation contains glycerol, propylene glycol, 1,3-propane diol and mixtures thereof in a combined amount of no greater than 0.1 wt. % based on the aerosolizable formulation or based on the aerosolized formulation. In one aspect the aerosolizable formulation contains glycerol, propylene glycol, 1,3-propane diol and mixtures thereof in a combined amount of no greater than 0.01 wt. % based on the aerosolizable formulation or based on the aerosolized formulation. In one aspect the aerosolizable formulation contains no glycerol, propylene glycol, 1,3-propane diol and mixtures thereof.

In one aspect the aerosolizable formulation contains glycerol, propylene glycol, and mixtures thereof in a combined amount of no greater than 10 wt. % based on the aerosolizable formulation or based on the aerosolized formulation. In one aspect the aerosolizable formulation contains glycerol, propylene glycol, and mixtures thereof in a combined amount of no greater than 8 wt. % based on the aerosolizable formulation or based on the aerosolized formulation. In one aspect the aerosolizable formulation contains glycerol, propylene glycol, and mixtures thereof in a combined amount of no greater than 5 wt. % based on the aerosolizable formulation or based on the aerosolized formulation. In one aspect the aerosolizable formulation contains glycerol, propylene glycol, and mixtures thereof in a combined amount of no greater than 2 wt. % based on the aerosolizable formulation or based on the aerosolized formulation. In one aspect the aerosolizable formulation contains glycerol, propylene glycol, and mixtures thereof in a combined amount of no greater than 1 wt. % based on the aerosolizable formulation or based on the aerosolized formulation. In one aspect the aerosolizable formulation contains glycerol, propylene glycol, and mixtures thereof in a combined amount of no greater than 0.5 wt. % based on the aerosolizable formulation or based on the aerosolized formulation. In one aspect the aerosolizable formulation contains glycerol, propylene glycol, and mixtures thereof in a combined amount of no greater than 0.2 wt. % based on the aerosolizable formulation or based on the aerosolized formulation. In one aspect the aerosolizable formulation contains glycerol, propylene glycol, and mixtures thereof in a combined amount of no greater than 0.1 wt. % based on the aerosolizable formulation or based on the aerosolized formulation. In one aspect the aerosolizable formulation contains glycerol, propylene glycol, and mixtures thereof in a combined amount of no greater than 0.01 wt. % based on the aerosolizable formulation or based on the aerosolized formulation. In one aspect the aerosolizable formulation contains no glycerol, propylene glycol, and mixtures thereof.

In one aspect the aerosolizable formulation contains glycerol in an amount of no greater than 10 wt. % based on the aerosolizable formulation or based on the aerosolized formulation. In one aspect the aerosolizable formulation contains glycerol in an amount of no greater than 8 wt. % based on the aerosolizable formulation or based on the aerosolized formulation. In one aspect the aerosolizable formulation contains glycerol in an amount of no greater than 5 wt. % based on the aerosolizable formulation or based on the aerosolized formulation. In one aspect the aerosolizable formulation contains glycerol in an amount of no greater than 2 wt. % based on the aerosolizable formulation or based on the aerosolized formulation. In one aspect the aerosolizable formulation contains glycerol in an amount of no greater than 1 wt. % based on the aerosolizable formulation or based on the aerosolized formulation. In one aspect the aerosolizable formulation contains glycerol in an amount of no greater than 0.5 wt. % based on the aerosolizable formulation or based on the aerosolized formulation. In one aspect the aerosolizable formulation contains glycerol in an amount of no greater than 0.2 wt. % based on the aerosolizable formulation or based on the aerosolized formulation. In one aspect the aerosolizable formulation contains glycerol in an amount of no greater than 0.1 wt. % based on the aerosolizable formulation or based on the aerosolized formulation. In one aspect the aerosolizable formulation contains glycerol in an amount of no greater than 0.01 wt. % based on the aerosolizable formulation or based on the aerosolized formulation. In one aspect the aerosolizable formulation contains no glycerol.

In one aspect the aerosolizable formulation contains propylene glycol in an amount of no greater than 10 wt. % based on the aerosolizable formulation or based on the aerosolized formulation. In one aspect the aerosolizable formulation contains propylene glycol in an amount of no greater than 8 wt. % based on the aerosolizable formulation or based on the aerosolized formulation. In one aspect the aerosolizable formulation contains propylene glycol in an amount of no greater than 5 wt. % based on the aerosolizable formulation or based on the aerosolized formulation. In one aspect the aerosolizable formulation contains propylene glycol in an amount of no greater than 2 wt. % based on the aerosolizable formulation or based on the aerosolized formulation. In one aspect the aerosolizable formulation contains propylene glycol in an amount of no greater than 1 wt. % based on the aerosolizable formulation or based on the aerosolized formulation. In one aspect the aerosolizable formulation contains propylene glycol in an amount of no greater than 0.5 wt. % based on the aerosolizable formulation or based on the aerosolized formulation. In one aspect the aerosolizable formulation contains propylene glycol in an amount of no greater than 0.2 wt. % based on the aerosolizable formulation or based on the aerosolized formulation. In one aspect the aerosolizable formulation contains propylene glycol in an amount of no greater than 0.1 wt. % based on the aerosolizable formulation or based on the aerosolized formulation. In one aspect the aerosolizable formulation contains propylene glycol in an amount of no greater than 0.01 wt. % based on the aerosolizable formulation or based on the aerosolized formulation. In one aspect the aerosolizable formulation contains no propylene glycol.

Flavor

The aerosolizable formulation comprises one or more flavors or flavoring components. As used herein, the terms "flavor" and "flavorant" refer to materials which, where local regulations permit, may be used to create a desired taste or aroma in a product for adult consumers. They may include extracts (e.g. liquorice, *hydrangea*, Japanese white bark *magnolia* leaf, chamomile, fenugreek, clove, menthol, Japanese mint, aniseed, cinnamon, herb, wintergreen, cherry, berry, peach, apple, Drambuie®, bourbon, scotch, whiskey, spearmint, peppermint, lavender, cardamom, celery, cascarilla, nutmeg, sandalwood, bergamot, geranium, honey essence, rose oil, vanilla, lemon oil, orange oil, *cassia*, caraway, cognac, jasmine, ylang-ylang, sage, fennel, piment, ginger, anise, coriander, coffee, or a mint oil from any species of the genus *Mentha*), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, oil, liquid, or powder. The one or more flavors may be selected from the group consisting of (4-(para-)methoxyphenyl)-2-butanone, vanillin, γ-undecalactone, menthone, 5-propenyl guaethol, menthol, para-mentha-8-thiol-3-one and mixtures thereof. In one aspect the flavor is at least menthol.

If present, the one or more flavors may be present in any suitable amount. In one aspect the one or more flavors are present in a total amount of no greater than 10 wt. % based on the aerosolized formulation. In one aspect the one or more flavors are present in a total amount of no greater than 7 wt. % based on the aerosolized formulation. In one aspect the one or more flavors are present in a total amount of no greater than 5 wt. % based on the aerosolized formulation. In one aspect the one or more flavors are present in a total amount of no greater than 4 wt. % based on the aerosolized formulation. In one aspect the one or more flavors are present in a total amount of no greater than 3 wt. % based on the aerosolized formulation. In one aspect the one or more flavors are present in a total amount of no greater than 2 wt. % based on the aerosolized formulation. In one aspect the one or more flavors are present in a total amount of no greater than 1 wt. % based on the aerosolized formulation.

In one aspect the one or more flavors are present in a total amount of from 0.01 to 5 wt. % based on the aerosolized formulation. In one aspect the one or more flavors are present in a total amount of from 0.01 to 4 wt. % based on the aerosolized formulation. In one aspect the one or more flavors are present in a total amount of from 0.01 to 3 wt. % based on the aerosolized formulation. In one aspect the one or more flavors are present in a total amount of from 0.01 to 2 wt. % based on the aerosolized formulation. In one aspect the one or more flavors are present in a total amount of from 0.01 to 1 wt. % based on the aerosolized formulation. In one aspect the one or more flavors are present in a total amount of from 0.01 to 0.5 wt. % based on the aerosolized formulation.

In one aspect the one or more flavors are present in a total amount of no greater than 10 wt. % based on the aerosolizable formulation. In one aspect the one or more flavors are present in a total amount of no greater than 7 wt. % based on the aerosolizable formulation. In one aspect the one or more flavors are present in a total amount of no greater than 5 wt. % based on the aerosolizable formulation. In one aspect the one or more flavors are present in a total amount of no greater than 4 wt. % based on the aerosolizable formulation. In one aspect the one or more flavors are present in a total amount of no greater than 3 wt. % based on the aerosolizable formulation. In one aspect the one or more flavors are present in a total amount of no greater than 2 wt. % based on the aerosolizable formulation. In one aspect the one or more flavors are present in a total amount of no greater than 1 wt. % based on the aerosolizable formulation.

In one aspect the one or more flavors are present in a total amount of from 0.01 to 5 wt. % based on the aerosolizable formulation. In one aspect the one or more flavors are present in a total amount of from 0.01 to 4 wt. % based on the aerosolizable formulation. In one aspect the one or more flavors are present in a total amount of from 0.01 to 3 wt. % based on the aerosolizable formulation. In one aspect the one or more flavors are present in a total amount of from 0.01 to 2 wt. % based on the aerosolizable formulation. In one aspect the one or more flavors are present in a total amount of from 0.01 to 1 wt. % based on the aerosolizable formulation. In one aspect the one or more flavors are present in a total amount of from 0.01 to 0.5 wt. % based on the aerosolizable formulation.

Nicotine

As is understood by one skilled in the art, nicotine may exist in unprotonated form, monoprotonated form or diprotonated form. The structures of each of these forms are given below.

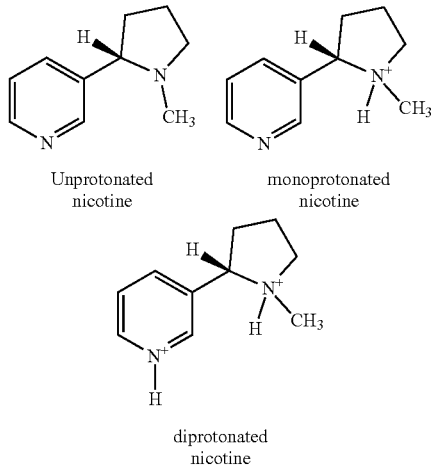

Reference in the specification to protonated form means both monoprotonated nicotine and diprotonated nicotine. Reference in the specification to amounts in the protonated form means the combined amount of monoprotonated nicotine and diprotonated nicotine. Furthermore, when reference is made to a fully protonated formulation it will be understood that at any one time there may be very minor amounts of unprotonated nicotine present, e.g. less than 1% unprotonated.

Nicotine formulations may be provided having desirable properties of flavor, impact, irritation, smoothness and/or nicotine reward for the user. In one aspect nicotine is present in an amount of no greater than 6 wt % based on the total weight of the aerosolizable formulation or the aerosolized formulation. In one aspect nicotine is present in an amount of from 0.01 to 6 wt % based on the total weight of the aerosolizable formulation or the aerosolized formulation. In one aspect nicotine is present in an amount of from 0.02 to 6 wt % based on the total weight of the aerosolizable formulation or the aerosolized formulation. In one aspect nicotine is present in an amount of from 0.05 to 6 wt % based on the total weight of the aerosolizable formulation or the aerosolized formulation. In one aspect nicotine is present in an amount of from 0.08 to 6 wt % based on the total weight of the aerosolizable formulation or the aerosolized formulation. In one aspect nicotine is present in an amount of from 0.01 to 5 wt % based on the total weight of the aerosolizable formulation or the aerosolized formulation. In one aspect nicotine is present in an amount of from 0.02 to 5 wt % based on the total weight of the aerosolizable formulation or the aerosolized formulation. In one aspect nicotine is present in an amount of from 0.05 to 5 wt % based on the total weight of the aerosolizable formulation or the aerosolized formulation. In one aspect nicotine is present in an amount of from 0.08 to 5 wt % based on the total weight of the aerosolizable formulation or the aerosolized formulation. In one aspect nicotine is present in an amount of no greater than 4 wt % based on the total weight of the aerosolizable formulation or the aerosolized formulation. In one aspect nicotine is present in an amount of from 0.01 to 4 wt % based on the total weight of the aerosolizable formulation or the aerosolized formulation. In one aspect nicotine is present in an amount of from 0.02 to 4 wt % based on the total weight of the aerosolizable formulation or the aerosolized formulation. In one aspect nicotine is present in an amount of from 0.05 to 4 wt % based on the total weight of the aerosolizable formulation or the aerosolized formulation. In one aspect nicotine is present in an amount of from 0.08 to 4 wt % based on the total weight of the aerosolizable formulation or the aerosolized formulation. In one aspect nicotine is present in an amount of no greater than 3 wt % based on the total weight of the aerosolizable formulation or the aerosolized formulation. In one aspect nicotine is present in an amount of from 0.01 to 3 wt % based on the total weight of the aerosolizable formulation or the aerosolized formulation. In one aspect nicotine is present in an amount of from 0.02 to 3 wt % based on the total weight of the aerosolizable formulation or the aerosolized formulation. In one aspect nicotine is present in an amount of from 0.05 to 3 wt % based on the total weight of the aerosolizable formulation or the aerosolized formulation. In one aspect nicotine is present in an amount of from 0.08 to 3 wt % based on the total weight of the aerosolizable formulation or the aerosolized formulation. In one aspect nicotine is present in an amount of no greater than 2 wt % based on the total weight of the aerosolizable formulation or the aerosolized formulation. In one aspect nicotine is present in an amount of from 0.01 to 2 wt % based on the total weight of the aerosolizable formulation or the aerosolized formulation. In one aspect nicotine is present in an amount of from 0.02 to 2 wt % based on the total weight of the aerosolizable formulation or the aerosolized formulation. In one aspect nicotine is present in an amount of from 0.05 to 2 wt % based on the total weight of the aerosolizable formulation or the aerosolized formulation. In one aspect nicotine is present in an amount of from 0.08 to 2 wt % based on the total weight of the aerosolizable formulation or the aerosolized formulation. In one aspect nicotine is present in an amount of no greater than 1 wt % based on the total weight of the aerosolizable formulation or the aerosolized formulation. In one aspect nicotine is present in an amount of from 0.01 to 1 wt % based on the total weight of the aerosolizable formulation or the aerosolized formulation. In one aspect nicotine is present in an amount of from 0.02 to 1 wt % based on the total weight of the aerosolizable formulation or the aerosolized formulation. In one aspect nicotine is present in an amount of from 0.05 to 1 wt % based on the total weight of the aerosolizable formulation or the aerosolized formulation. In one aspect nicotine is present in an amount of from 0.08 to 1 wt % based on the total weight of the aerosolizable formulation or the aerosolized formulation. In one aspect nicotine is present in an amount of from 0.1 to 1 wt % based on the total weight of the aerosolizable formulation or the aerosolized formulation. In one aspect nicotine is present in an amount of no greater than 0.6 wt % based on the total weight of the aerosolizable formulation or the aerosolized formulation. In one aspect nicotine is present in an amount of from 0.01 to 0.6 wt % based on the total weight of the aerosolizable formulation or the aerosolized formulation. In one aspect nicotine is present in an amount of from 0.02 to 0.6 wt % based on the total weight of the aerosolizable formulation or the aerosolized formulation. In one aspect nicotine is present in an amount of from 0.05 to 0.6 wt % based on the total weight of the aerosolizable formulation or the aerosolized formulation. In one aspect nicotine is present in an amount of from 0.08 to 0.6 wt % based on the total weight of the aerosolizable formulation or the aerosolized formulation. In one aspect nicotine is present in an amount of from 0.1 to 0.6 wt % based on the total weight of the aerosolizable formulation or the aerosolized formulation. In one aspect nicotine is present in an amount of no greater than 0.5 wt % based on the total weight of the aerosolizable formulation or the aerosolized formulation. In one aspect nicotine is present in an amount of from 0.01 to 0.5 wt % based on the total weight of the aerosolizable formulation or the aerosolized formulation. In one aspect nicotine is present in an amount of from 0.02 to 0.5 wt % based on the total weight of the aerosolizable formulation or the aerosolized formulation. In one aspect nicotine is present in an amount of from 0.05 to 0.5 wt % based on the total weight of the aerosolizable formulation or the aerosolized formulation. In one aspect nicotine is present in an amount of from 0.08 to 0.5 wt % based on the total weight of the aerosolizable formulation or the aerosolized formulation. In one aspect nicotine is present in an amount of no greater than 0.2 wt % based on the total weight of the aerosolizable formulation or the aerosolized formulation. In one aspect nicotine is present in an amount of from 0.01 to 0.2 wt % based on the total weight of the aerosolizable formulation or the aerosolized formulation. In one aspect nicotine is present in an amount of from 0.02 to 0.2 wt % based on the total weight of the aerosolizable formulation or the aerosolized formulation. In one aspect nicotine is present in an amount of from 0.05 to 0.2 wt % based on the total weight of the aerosolizable formulation or the aerosolized formulation. In one aspect nicotine is present in an amount of from 0.08 to 0.2 wt % based on the total weight of the aerosolizable formulation or the aerosolized formulation. In one aspect nicotine is present in an amount of no greater than 0.1 wt % based on the total weight of the aerosolizable formulation or the aerosolized formulation. In one aspect nicotine is present in an amount of from 0.01 to 0.1 wt % based on the total weight of the aerosolizable formulation or the aerosolized formulation. In one aspect nicotine is present in an amount of from 0.02 to 0.1 wt % based on the total weight of the aerosolizable formulation or the aerosolized formulation. In one aspect nicotine is present in an amount of from 0.05 to 0.1 wt % based on the total weight of the aerosolizable formulation or the aerosolized formulation. In one aspect nicotine is present in an amount of from 0.08 to 0.1 wt % based on the total weight of the aerosolizable formulation or the aerosolized formulation.

The formulation may comprise nicotine in protonated form. The formulation may comprise nicotine in unprotonated form. In one aspect the formulation comprises nicotine in unprotonated form and nicotine in monoprotonated form. In one aspect the formulation comprises nicotine in unprotonated form and nicotine in diprotonated form. In one aspect the formulation comprises nicotine in unprotonated form, nicotine in monoprotonated form and nicotine in diprotonated form.

In one aspect at least 5 wt % of the nicotine present in the formulation is in protonated form. In one aspect at least 10 wt % of the nicotine present in the formulation is in protonated form. In one aspect at least 15 wt % of the nicotine present in the formulation is in protonated form. In one aspect at least 20 wt % of the nicotine present in the formulation is in protonated form. In one aspect at least 25 wt % of the nicotine present in the formulation is in protonated form. In one aspect at least 30 wt % of the nicotine present in the formulation is in protonated form. In one aspect at least 35 wt % of the nicotine present in the formulation is in protonated form. In one aspect at least 40 wt % of the nicotine present in the formulation is in protonated form. In one aspect at least 45 wt % of the nicotine present in the formulation is in protonated form. In one aspect at least 50 wt % of the nicotine present in the formulation is in protonated form. In one aspect at least 55 wt % of the nicotine present in the formulation is in protonated form. In one aspect at least 60 wt % of the nicotine present in the formulation is in protonated form. In one aspect at least 65 wt % of the nicotine present in the formulation is in protonated form. In one aspect at least 70 wt % of the nicotine present in the formulation is in protonated form. In one aspect at least 75 wt % of the nicotine present in the formulation is in protonated form. In one aspect at least 80 wt % of the nicotine present in the formulation is in protonated form. In one aspect at least 85 wt % of the nicotine present in the formulation is in protonated form. In one aspect at least 90 wt % of the nicotine present in the formulation is in protonated form. In one aspect at least 95 wt % of the nicotine present in the formulation is in protonated form. In one aspect at least 99 wt % of the nicotine present in the formulation is in protonated form. In one aspect at least 99.9 wt % of the nicotine present in the formulation is in protonated form.

In one aspect from 50 to 95 wt % of the nicotine present in the formulation is in protonated form. In one aspect from 55 to 95 wt % of the nicotine present in the formulation is in protonated form. In one aspect from 60 to 95 wt % of the nicotine present in the formulation is in protonated form. In one aspect from 65 to 95 wt % of the nicotine present in the formulation is in protonated form. In one aspect from 70 to 95 wt % of the nicotine present in the formulation is in protonated form. In one aspect from 75 to 95 wt % of the nicotine present in the formulation is in protonated form. In one aspect from 80 to 95 wt % of the nicotine present in the formulation is in protonated form. In one aspect from 85 to 95 wt % of the nicotine present in the formulation is in protonated form. In one aspect from 90 to 95 wt % of the nicotine present in the formulation is in protonated form.

In one aspect from 50 to 99 wt % of the nicotine present in the formulation is in protonated form. In one aspect from 55 to 99 wt % of the nicotine present in the formulation is in protonated form. In one aspect from 60 to 99 wt % of the nicotine present in the formulation is in protonated form. In one aspect from 65 to 99 wt % of the nicotine present in the formulation is in protonated form. In one aspect from 70 to 99 wt % of the nicotine present in the formulation is in protonated form. In one aspect from 75 to 99 wt % of the nicotine present in the formulation is in protonated form. In one aspect from 80 to 99 wt % of the nicotine present in the formulation is in protonated form. In one aspect from 85 to 99 wt % of the nicotine present in the formulation is in protonated form. In one aspect from 90 to 99 wt % of the nicotine present in the formulation is in protonated form.

The relevant amounts of nicotine which are present in the formulation in protonated form are specified herein. These amounts may be readily calculated by one skilled in the art. Nicotine, 3-(1-methylpyrrolidin-2-yl) pyridine, is a diprotic base with pKa of 3.12 for the pyridine ring and 8.02 for the pyrrolidine ring It can exist in pH-dependent protonated (mono- and di-) and non-protonated (free base) forms which have different bioavailability.

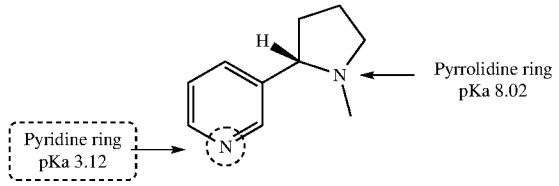

The distribution of protonated and non-protonated nicotine will vary at various pH increments.

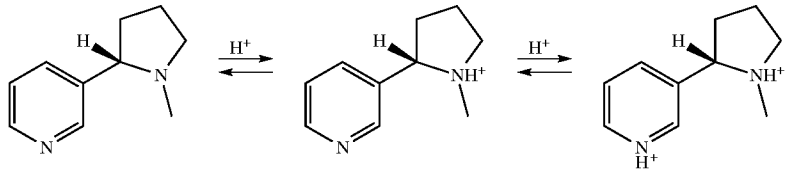

The fraction of non-protonated nicotine will be predominant at high pH levels whilst a decrease in the pH will see an increase of the fraction of protonated nicotine (mono- or di-depending on the pH). If the relative fraction of protonated nicotine and the total amount of nicotine in the sample are known, the absolute amount of protonated nicotine can be calculated.

The relative fraction of protonated nicotine in formulation can be calculated by using the Henderson-Hasselbalch equation, which describes the pH as a derivation of the acid dissociation constant equation, and it is extensively employed in chemical and biological systems. Consider the following equilibrium:

$$B + H^+ \rightleftharpoons BH^+$$

The Henderson-Hasselbalch equation for this equilibrium is:

$$\mathrm{pH} = pKa + \log\frac{[B]}{[BH+]}$$

Where [B] is the amount of non-protonated nicotine (i.e. free base), [BH+] the amount of protonated nicotine (i.e. conjugate acid) and pKa is the reference pKa value for the pyrrolidine ring nitrogen of nicotine (pKa=8.02). The relative fraction of protonated nicotine can be derived from the alpha value of the non-protonated nicotine calculated from the Henderson-Hasselbalch equation as:

$$\%\ \text{protonated nicotine} = 100 - \left\{\frac{\frac{[B]}{[BH+]}}{\left\{1 + \frac{[B]}{[BH+]}\right\}} * 100\right\}$$

Determination of pKa values of nicotine formulations was carried out using the basic approach described in "Spectroscopic investigations into the acid-base properties of nicotine at different temperatures", Peter M. Clayton, Carl A. Vas, Tam T. T. Bui, Alex F. Drake and Kevin McAdam, .Anal. Methods, 2013, 5, 81-88.

Acid

As discussed above, the aerosolizable formulation and the aerosolized formulation of the present invention may contain one or more further components. These components may be selected depending on the nature of the formulation. In one aspect, the aerosolizable formulation and the aerosolized formulation further comprises an acid In one aspect the acid is an organic acid. In one aspect the acid is a carboxylic acid. In one aspect the acid is an organic carboxylic acid.

In one aspect the acid is selected from the group consisting of acetic acid, lactic acid, formic acid, citric acid, benzoic acid, pyruvic acid, levulinic acid, succinic acid, tartaric acid, sorbic acid, propionic acid, phenylacetic acid, and mixtures thereof. In one aspect the acid is selected from the group consisting of citric acid, benzoic acid, levulinic acid, lactic acid, sorbic acid, and mixtures thereof. In one aspect the acid is selected from the group consisting of citric acid, benzoic acid, levulinic acid, and mixtures thereof. In one aspect the acid is at least citric acid. In one aspect the acid consists of citric acid.

In one aspect the acid is selected from acids having a pKa of from 2 to 5. In one aspect the acid is a weak acid. In one aspect the acid is a weak organic acid.

In one aspect the acid has a solubility in water of at least 5 g/L at 20° C. In one aspect the acid has a solubility in water of at least 10 g/L at 20° C. In one aspect the acid has a solubility in water of at least 20 g/L at 20° C. In one aspect the acid has a solubility in water of at least 50 g/L at 20° C. In one aspect the acid has a solubility in water of at least 100 g/L at 20° C. In one aspect the acid has a solubility in water of at least 200 g/L at 20° C. In one aspect the acid has a solubility in water of at least 300 g/L at 20° C. In one aspect the acid has a solubility in water of at least 400 g/L at 20° C. In one aspect the acid has a solubility in water of at least 500 g/L at 20° C. In one aspect the acid has a solubility in water of at least 600 g/L at 20° C. In one aspect the acid has a solubility in water of at least 700 g/L at 20° C. In one aspect the acid has a solubility in water of at least 800 g/L at 20° C. In one aspect the acid has a solubility in water of at least 900 g/L at 20° C. In one aspect the acid has a solubility in water of at least 1000 g/L at 20° C. In one aspect the acid has a solubility in water of at least 1100 g/L at 20° C.

The molar ratio of acid to nicotine may be selected as desired. In one aspect the molar ratio of acid to nicotine is from 5:1 to 1:5. In one aspect the molar ratio of acid to nicotine is from 4:1 to 1:4. In one aspect the molar ratio of acid to nicotine is from 3:1 to 1:3. In one aspect the molar ratio of acid to nicotine is from 2:1 to 1:2. In one aspect the molar ratio of acid to nicotine is from 1.5:1 to 1:1.5. In one aspect the molar ratio of acid to nicotine is from 1.2:1 to 1:1.2. In one aspect the molar ratio of acid to nicotine is from 5:1 to 1:1. In one aspect the molar ratio of acid to nicotine is from 4:1 to 1:1. In one aspect the molar ratio of acid to nicotine is from 3:1 to 1:1. In one aspect the molar ratio of acid to nicotine is from 2:1 to 1:1. In one aspect the molar ratio of acid to nicotine is from 1.5:1 to 1:1. In one aspect the molar ratio of acid to nicotine is from 1.2:1 to 1:1.

In one aspect the total content of acid present in the formulation is no greater than 5 mole equivalents based on the nicotine. In one aspect the total content of acid present in the formulation is no greater than 4 mole equivalents based on the nicotine. In one aspect the total content of acid present in the formulation is no greater than 3 mole equivalents based on the nicotine. In one aspect the total content of acid present in the formulation is no greater than 2 mole equivalents based on the nicotine. In one aspect the total content of acid present in the formulation is no greater than 1 mole equivalents based on the nicotine.

In one aspect the total content of acid present in the formulation is no less than 0.01 mole equivalents based on the nicotine. In one aspect the total content of acid present in the formulation is no less than 0.05 mole equivalents based on the nicotine. In one aspect the total content of acid present in the formulation is no less than 0.1 mole equivalents based on the nicotine. In one aspect the total content of acid present in the formulation is no less than 0.2 mole equivalents based on the nicotine. In one aspect the total content of acid present in the formulation is no less than 0.3 mole equivalents based on the nicotine. In one aspect the total content of acid present in the formulation is no less than 0.4 mole equivalents based on the nicotine. In one aspect the total content of acid present in the formulation is no less than 0.5 mole equivalents based on the nicotine. In one aspect the total content of acid present in the formulation is no less than 0.7 mole equivalents based on the nicotine.

The acid may be present in any suitable amount. In one aspect the acid is present in an amount of no greater than 6 wt % based on the aerosolizable formulation or based on the aerosolized formulation. In one aspect the acid is present in an amount of from 0.01 to 6 wt % based on the aerosolizable formulation or based on the aerosolized formulation. In one aspect the acid is present in an amount of from 0.02 to 6 wt % based on the aerosolizable formulation or based on the aerosolized formulation. In one aspect the acid is present in an amount of from 0.05 to 6 wt % based on the aerosolizable formulation or based on the aerosolized formulation. In one aspect the acid is present in an amount of from 0.08 to 6 wt % based on the aerosolizable formulation or based on the aerosolized formulation. In one aspect the acid is present in an amount of from 0.01 to 5 wt % based on the aerosolizable formulation or based on the aerosolized formulation. In one aspect the acid is present in an amount of from 0.02 to 5 wt % based on the aerosolizable formulation or based on the aerosolized formulation. In one aspect the acid is present in an amount of from 0.05 to 5 wt % based on the aerosolizable formulation or based on the aerosolized formulation. In one aspect the acid is present in an amount of from 0.08 to 5 wt % based on the aerosolizable formulation or based on the aerosolized formulation. In one aspect the acid is present in an amount of no greater than 4 wt % based on the aerosolizable formulation or based on the aerosolized formulation. In one aspect the acid is present in an amount of from 0.01 to 4 wt % based on the aerosolizable formulation or based on the aerosolized formulation. In one aspect the acid is present in an amount of from 0.02 to 4 wt % based on the aerosolizable formulation or based on the aerosolized formulation. In one aspect the acid is present in an amount of from 0.05 to 4 wt % based on the aerosolizable formulation or based on the aerosolized formulation. In one aspect the acid is present in an amount of from 0.08 to 4 wt % based on the aerosolizable formulation or based on the aerosolized formulation. In one aspect the acid is present in an amount of no greater than 3 wt % based on the aerosolizable formulation or based on the aerosolized formulation. In one aspect the acid is present in an amount of from 0.01 to 3 wt % based on the aerosolizable formulation or based on the aerosolized formulation. In one aspect the acid is present in an amount of from 0.02 to 3 wt % based on the aerosolizable formulation or based on the aerosolized formulation. In one aspect the acid is present in an amount of from 0.05 to 3 wt % based on the aerosolizable formulation or based on the aerosolized formulation. In one aspect the acid is present in an amount of from 0.08 to 3 wt % based on the aerosolizable formulation or based on the aerosolized formulation. In one aspect the acid is present in an amount of no greater than 2 wt % based on the aerosolizable formulation or based on the aerosolized formulation. In one aspect the acid is present in an amount of from 0.01 to 2 wt % based on the aerosolizable formulation or based on the aerosolized formulation. In one aspect the acid is present in an amount of from 0.02 to 2 wt % based on the aerosolizable formulation or based on the aerosolized formulation. In one aspect the acid is present in an amount of from 0.05 to 2 wt % based on the aerosolizable formulation or based on the aerosolized formulation. In one aspect the acid is present in an amount of from 0.08 to 2 wt % based on the aerosolizable formulation or based on the aerosolized formulation. In one aspect the acid is present in an amount of no greater than 1 wt % based on the aerosolizable formulation or based on the aerosolized formulation. In one aspect the acid is present in an amount of from 0.01 to 1 wt % based on the aerosolizable formulation or based on the aerosolized formulation. In one aspect the acid is present in an amount of from 0.02 to 1 wt % based on the aerosolizable formulation or based on the aerosolized formulation. In one aspect the acid is present in an amount of from 0.05 to 1 wt % based on the aerosolizable formulation or based on the aerosolized formulation. In one aspect the acid is present in an amount of from 0.08 to 1 wt % based on the aerosolizable formulation or based on the aerosolized formulation. In one aspect the acid is present in an amount of from 0.1 to 1 wt % based on the aerosolizable formulation or based on the aerosolized formulation. In one aspect the acid is present in an amount of no greater than 0.6 wt % based on the aerosolizable formulation or based on the aerosolized formulation. In one aspect the acid is present in an amount of from 0.01 to 0.6 wt % based on the aerosolizable formulation or based on the aerosolized formulation. In one aspect the acid is present in an amount of from 0.02 to 0.6 wt % based on the aerosolizable formulation or based on the aerosolized formulation. In one aspect the acid is present in an amount of from 0.05 to 0.6 wt % based on the aerosolizable formulation or based on the aerosolized formulation. In one aspect the acid is present in an amount of from 0.08 to 0.6 wt % based on the aerosolizable formulation or based on the aerosolized formulation. In one aspect the acid is present in an amount of from 0.1 to 0.6 wt % based on the aerosolizable formulation or based on the aerosolized formulation. In one aspect the acid is present in an amount of no greater than 0.5 wt % based on the aerosolizable formulation or based on the aerosolized formulation. In one aspect the acid is present in an amount of from 0.01 to 0.5 wt % based on the aerosolizable formulation or based on the aerosolized formulation. In one aspect the acid is present in an amount of from 0.02 to 0.5 wt % based on the aerosolizable formulation or based on the aerosolized formulation. In one aspect the acid is present in an amount of from 0.05 to 0.5 wt % based on the aerosolizable formulation or based on the aerosolized formulation. In one aspect the acid is present in an amount of from 0.08 to 0.5 wt % based on the aerosolizable formulation or based on the aerosolized formulation. In one aspect the acid is present in an amount of no greater than 0.2 wt % based on the aerosolizable formulation or based on the aerosolized formulation. In one aspect the acid is present in an amount of from 0.01 to 0.2 wt % based on the aerosolizable formulation or based on the aerosolized formulation. In one aspect the acid is present in an amount of from 0.02 to 0.2 wt % based on the aerosolizable formulation or based on the aerosolized formulation. In one aspect the acid is present in an amount of from 0.05 to 0.2 wt % based on the aerosolizable formulation or based on the aerosolized formulation. In one aspect the acid is present in an amount of from 0.08 to 0.2 wt % based on the aerosolizable formulation or based on the aerosolized formulation. In one aspect the acid is present in an amount of no greater than 0.1 wt % based on the aerosolizable formulation or based on the aerosolized formulation. In one aspect the acid is present in an amount of from 0.01 to 0.1 wt % based on the aerosolizable formulation or based on the aerosolized formulation. In one aspect the acid is present in an amount of from 0.02 to 0.1 wt % based on the aerosolizable formulation or based on the aerosolized formulation. In one aspect the acid is present in an amount of from 0.05 to 0.1 wt % based on the aerosolizable formulation or based on the aerosolized formulation. In one aspect the acid is present in an amount of from 0.08 to 0.1 wt % based on the aerosolizable formulation or based on the aerosolized formulation.

The amount of acid and the solubility of the acid may be selected such that a given amount of the acid will dissolve in the water. In one aspect at 20° C. at least 20% of the acid dissolves in the water. In one aspect at 25° C. at least 20% of the acid dissolves in the water. In one aspect at 30° C. at least 20% of the acid dissolves in the water. In one aspect at 20° C. at least 35% of the acid dissolves in the water. In one aspect at 20° C. at least 40% of the acid dissolves in the water. In one aspect at 20° C. at least 45% of the acid dissolves in the water. In one aspect at 20° C. at least 50% of the acid dissolves in the water. In one aspect at 20° C. at least 55% of the acid dissolves in the water.

Encapsulating Material

The aerosolizable formulation or the aerosolized formulation may comprise one or more encapsulating materials. The one or more encapsulating materials may be present in any suitable amount in the aerosolizable formulation or the aerosolized formulation. We have found that by providing one or more encapsulating materials the required distribution of flavor and nicotine may particularly be delivered, namely at least 50 wt. % of the one or more flavors is present in the vapor phase; and at least 50 wt. % of the nicotine is present in the liquid water droplet phase. In one aspect the one or more encapsulating materials are present in a total amount of no greater than 12 wt. % based on the aerosolizable formulation or the aerosolized formulation. In one aspect the one or more encapsulating materials are present in a total amount of no greater than 10 wt. % based on the aerosolizable formulation or the aerosolized formulation. In one aspect the one or more encapsulating materials are present in a total amount of no greater than 9 wt. % based on the aerosolizable formulation or the aerosolized formulation. In one aspect the one or more encapsulating materials are present in a total amount of no greater than 8 wt. % based on the aerosolizable formulation or the aerosolized formulation. In one aspect the one or more encapsulating materials are present in a total amount of no greater than 7 wt. % based on the aerosolizable formulation or the aerosolized formulation. In one aspect the one or more encapsulating materials are present in a total amount of no greater than 6 wt. % based on the aerosolizable formulation or the aerosolized formulation. In one aspect the one or more encapsulating materials are present in a total amount of no greater than 5 wt. % based on the aerosolizable formulation or the aerosolized formulation. In one aspect the one or more encapsulating materials are present in a total amount of no greater than 4 wt. % based on the aerosolizable formulation or the aerosolized formulation. In one aspect the one or more encapsulating materials are present in a total amount of no greater than 3 wt. % based on the aerosolizable formulation or the aerosolized formulation. In one aspect the one or more encapsulating materials are present in a total amount of no greater than 2 wt. % based on the aerosolizable formulation or the aerosolized formulation. In one aspect the one or more encapsulating materials are present in a total amount of no greater than 1 wt. % based on the aerosolizable formulation or the aerosolized formulation. In one aspect the one or more encapsulating materials are present in a total amount of no greater than 0.1 wt. % based on the aerosolizable formulation or the aerosolized formulation. In one aspect the one or more encapsulating materials are present in a total amount of no greater than 0.01 wt. % based on the aerosolizable formulation or the aerosolized formulation. In one aspect the one or more encapsulating materials are present in a total amount of no greater than 0.001 wt. % based on the aerosolizable formulation or the aerosolized formulation.

In one aspect the one or more encapsulating materials is selected from the group consisting of micelles, cyclodextrins, calixarenes, metal organic frameworks, dendrimers, polymers, hydrocolloids, pollen spores, yeast particles, porous silica, and mixtures thereof. In one aspect the one or more encapsulating materials are selected from cyclodextrins and mixtures thereof.

The one or more cyclodextrins may be selected from the group consisting of unsubstituted cyclodextrins, substituted cyclodextrins and mixtures thereof. In one aspect at least one cyclodextrin is an unsubstituted cyclodextrin. In one aspect the one or more cyclodextrins are selected from the group consisting of unsubstituted cyclodextrins. In one aspect at least one cyclodextrin is a substituted cyclodextrin. In one aspect the one or more cyclodextrins are selected from the group consisting of substituted cyclodextrins.

In one aspect the one or more cyclodextrins are selected from the group consisting of unsubstituted (α)-cyclodextrin, substituted (α)-cyclodextrin, unsubstituted (β)-cyclodextrin, substituted (β)-cyclodextrin, unsubstituted (γ)-cyclodextrin, substituted (γ)-cyclodextrin, and mixtures thereof. In one aspect the one or more cyclodextrins are selected from the group consisting of unsubstituted (β)-cyclodextrin, substituted (β)-cyclodextrin, and mixtures thereof.

In one aspect the one or more cyclodextrins are selected from the group consisting of unsubstituted (α)-cyclodextrin, unsubstituted (β)-cyclodextrin, unsubstituted (γ)-cyclodextrin, and mixtures thereof. In one aspect the one or more cyclodextrins is selected from unsubstituted (β)-cyclodextrin.

In one aspect the one or more cyclodextrins are selected from the group consisting of substituted (α)-cyclodextrin, substituted (β)-cyclodextrin, substituted (γ)-cyclodextrin, and mixtures thereof. In one aspect the one or more cyclodextrins is selected from substituted (β)-cyclodextrins. Chemical substitutions at the 2-, 3-, and 6-hydroxyl sites are envisaged, and in particular substitution at the 2-position.

In one aspect the one or more cyclodextrins are selected from the group consisting of 2-hydroxy-propyl-α-cyclodextrin, 2-hydroxy-propyl-β-cyclodextrin, 2-hydroxy-propyl-γ-cyclodextrin and mixtures thereof. In one aspect the one or more cyclodextrins is at least 2-hydroxy-propyl-α-cyclodextrin. In one aspect the one or more cyclodextrins is at least 2-hydroxy-propyl-β-cyclodextrin. In one aspect the one or more cyclodextrins is at least 2-hydroxy-propyl-γ-cyclodextrin.

2-hydroxy-propyl derivatives of cyclodextrins, such as 2-hydroxy-propyl-β-cyclodextrin have increased solubility in water when compared to base cyclodextrins such as β-cyclodextrin.

One or more cyclodextrins may or may not be present in any suitable amount in the aerosolizable formulation or the aerosolized formulation. In one aspect the one or more cyclodextrins are present in a total amount of no greater than 12 wt. % based on the aerosolizable formulation or the aerosolized formulation. In one aspect the one or more cyclodextrins are present in a total amount of no greater than 10 wt. % based on the aerosolizable formulation or the aerosolized formulation. In one aspect the one or more cyclodextrins are present in a total amount of no greater than 9 wt. % based on the aerosolizable formulation or the aerosolized formulation. In one aspect the one or more cyclodextrins are present in a total amount of no greater than 8 wt. % based on the aerosolizable formulation or the aerosolized formulation. In one aspect the one or more cyclodextrins are present in a total amount of no greater than 7 wt. % based on the aerosolizable formulation or the aerosolized formulation. In one aspect the one or more cyclodextrins are present in a total amount of no greater than 6 wt. % based on the aerosolizable formulation or the aerosolized formulation. In one aspect the one or more cyclodextrins are present in a total amount of no greater than 5 wt. % based on the aerosolizable formulation or the aerosolized formulation. In one aspect the one or more cyclodextrins are present in a total amount of no greater than 4 wt. % based on the aerosolizable formulation or the aerosolized formulation. In one aspect the one or more cyclodextrins are present in a total amount of no greater than 3 wt. % based on the aerosolizable formulation or the aerosolized formulation. In one aspect the one or more cyclodextrins are present in a total amount of no greater than 2 wt. % based on the aerosolizable formulation or the aerosolized formulation. In one aspect the one or more cyclodextrins are present in a total amount of no greater than 1 wt. % based on the aerosolizable formulation or the aerosolized formulation. In one aspect the one or more cyclodextrins are present in a total amount of no greater than 0.1 wt. % based on the aerosolizable formulation or the aerosolized formulation. In one aspect the one or more cyclodextrins are present in a total amount of no greater than 0.01 wt. % based on the aerosolizable formulation or the aerosolized formulation. In one aspect the one or more cyclodextrins are present in a total amount of no greater than 0.001 wt. % based on the aerosolizable formulation or the aerosolized formulation.

Formulation

As discussed herein, at least 50 wt. % of the one or more flavors is present in the vapor phase. In one aspect, at least 55 wt. % of the one or more flavors is present in the vapor phase. In one aspect, at least 60 wt. % of the one or more flavors is present in the vapor phase. In one aspect, at least 65 wt. % of the one or more flavors is present in the vapor phase. In one aspect, at least 70 wt. % of the one or more flavors is present in the vapor phase. In one aspect, at least 75 wt. % of the one or more flavors is present in the vapor phase. In one aspect, at least 80 wt. % of the one or more flavors is present in the vapor phase. In one aspect, at least 85 wt. % of the one or more flavors is present in the vapor phase. In one aspect, at least 90 wt. % of the one or more flavors is present in the vapor phase.

In one aspect, at least 5 wt. % of the nicotine is present in the liquid water droplet phase. In one aspect, at least 10 wt. % of the nicotine is present in the liquid water droplet phase. In one aspect, at least 15 wt. % of the nicotine is present in the liquid water droplet phase. In one aspect, at least 20 wt. % of the nicotine is present in the liquid water droplet phase. In one aspect, at least 25 wt. % of the nicotine is present in the liquid water droplet phase. In one aspect, at least 30 wt. % of the nicotine is present in the liquid water droplet phase. In one aspect, at least 35 wt. % of the nicotine is present in the liquid water droplet phase. In one aspect, at least 40 wt. % of the nicotine is present in the liquid water droplet phase. In one aspect, at least 45 wt. % of the nicotine is present in the liquid water droplet phase. In one aspect, at least 50 wt. % of the nicotine is present in the liquid water droplet phase. In one aspect, at least 55 wt. % of the nicotine is present in the liquid water droplet phase. In one aspect, at least 60 wt. % of the nicotine is present in the liquid water droplet phase. In one aspect, at least 65 wt. % of the nicotine is present in the liquid water droplet phase. In one aspect, at least 70 wt. % of the nicotine is present in the liquid water droplet phase. In one aspect, at least 75 wt. % of the nicotine is present in the liquid water droplet phase. In one aspect, at least 80 wt. % of the nicotine is present in the liquid water droplet phase. In one aspect, at least 85 wt. % of the nicotine is present in the liquid water droplet phase. In one aspect, at least 90 wt. % of the nicotine is present in the liquid water droplet phase.

In one aspect if the aerosolizable formulation contains one or more cyclodextrins, then the aerosolizable formulation contains no flavors that can be encapsulated by the one or more cyclodextrins.

Process

As discussed herein, in one aspect there is provided a process for forming an aerosol, the process comprising aerosolizing an aerosolizable formulation comprising (i) water in an amount of at least 50 wt. % based on the aerosolized formulation;

(ii) one or more flavors; and (iii) nicotine;

to provide an aerosol comprising a vapor phase and a liquid water droplet phase, wherein at least 50 wt. % of the one or more flavors is present in the va vapor pour phase.

As discussed herein, in one aspect there is provided a process for improving delivery of flavor to an aerosolized formulation, the process comprising the steps of (a) providing an aerosolizable composition comprising (i) water in an amount of at least 50 wt. % based on the aerosolized formulation;

(ii) one or more flavors; and (iii) nicotine;

(b) aerosolizing the aerosolizable composition to provide an aerosol comprising a vapor phase and a liquid water droplet phase, wherein at least 50 wt. % of the one or more flavors is present in the vapor phase.

In the process the aerosol may be formed by a process performed at a temperature below 60° C. In the process the aerosol may be formed by a process performed at a temperature below 50° C. In the process the aerosol may be formed by a process performed at a temperature below 40° C. In the process the aerosol may be formed by a process performed at a temperature below 30° C. In the process the aerosol may be formed by a process performed at a temperature below 25° C. In the process the aerosol may be formed by a process which does not involve heating.

In the process the aerosol may be formed by applying ultrasonic energy to the aerosolizable formulation.

In one aspect the aerosol the aerosol of the aerosolized formulation has a D50 of from 2 to 6 μm. References in the present specification to particle size distribution, D50, D10 or D90 refer to values measured in accordance with British and European Pharmacopoeia, 2.9.31 Particle Size Analysis By Laser Light Diffraction (see BRITISH PHARMACOPOEIA COMMISSION. (2014), British Pharmacopoeia. London, England: Stationery Office and COUNCIL OF EUROPE. (2013). European Pharmacopoeia. Strasbourg, France: Council of Europe). The terms D50, Dv50 and Dx50 are interchangeable. The terms D10, Dv10 and Dx10 are interchangeable. The terms D90, Dv90 and Dx90 are interchangeable.

In one aspect the aerosol has a D50 of from 2.5 to 6 μm. In one aspect the aerosol has a D50 of from 3 to 6 μm. In one aspect the aerosol has a D50 of from 3.5 to 6 μm. In one aspect the aerosol has a D50 of from 4 to 6 μm. In one aspect the aerosol has a D50 of from 4.5 to 6 μm. In one aspect the aerosol has a D50 of from 5 to 6 μm. In one aspect the aerosol has a D50 of from 2.5 to 5.5 μm. In one aspect the aerosol has a D50 of from 3 to 5.5 μm. In one aspect the aerosol has a D50 of from 3.5 to 5.5 μm. In one aspect the aerosol has a D50 of from 4 to 5.5 μm. In one aspect the aerosol has a D50 of from 4.5 to 5.5 μm. In one aspect the aerosol has a D50 of from 5 to 5.5 μm.

In one aspect the aerosol has a D10 of at least 0.5 μm. In one aspect the aerosol has a D10 of at least 1 μm. In one aspect the aerosol has a D10 of at least 2 μm.

In one aspect the aerosol has a D90 of no greater than 15 μm. In one aspect the aerosol has a D90 of no greater than 12 μm. In one aspect the aerosol has a D90 of no greater than 10 μm.

In one aspect D50 is measured after exclusion of particles having a particle size of less than 1 μm. In one aspect D10 is measured after exclusion of particles having a particle size of less than 1 μm. In one aspect D90 is measured after exclusion of particles having a particle size of less than 1 μm.

The formulation may be contained or delivered by any means. In one aspect the present invention provides a contained aerosolizable formulation comprising (a) one or more containers; and (b) an aerosolizable formulation as defined herein. The container may be any suitable container, for example to allow for the storage or delivery of the formulation. In one aspect the container is configured for engagement with an electronic aerosol provision system. The container may be configured to become fluidly in communication with an electronic aerosol provision system so that formulation may be delivered to the electronic vapor provision system. As described above, the present disclosure relates to container which may be used in an electronic aerosol provision system, such as an e-cigarette. Throughout the following description the term "e-cigarette" is used; however, this term may be used interchangeably with electronic aerosol provision system.

As discussed herein, the container of the present invention is typically provided for the delivery of aerosolizable formulation to or within an e-cigarette. The aerosolizable formulation may be held within an e-cigarette or may be sold as a separate container for subsequent use with or in an e-cigarette. As understood by one skilled in the art, e-cigarettes may contain a unit known as a detachable cartomizer which typically comprises a reservoir of aerosolizable formulation, a wick material and a heating element for vaporizing the aerosolizable formulation. In some e-cigarettes, the cartomizer is part of a single-piece device and is not detachable. In one aspect the container is a cartomizer or is part of a cartomizer. In one aspect the container is not a cartomizer or part of a cartomizer and is a container, such as a tank, which may be used to deliver nicotine formulation to or within an e-cigarette.

In one aspect the container is part of an e-cigarette. Therefore in a further aspect the present invention provides an electronic aerosol provision system comprising: an aerosolizable formulation as defined herein; an aerosolizer for aerosolizing formulation for inhalation by a user of the electronic aerosol provision system; and a power supply comprising a cell or battery for supplying power to the aerosolizer.

In addition to the aerosolizable formulation of the present invention and to systems such as containers and electronic aerosol provision systems containing the same, the present invention provides a process for improving the sensory properties of an aerosolized nicotine.

Reference to an improvement in the sensory properties of a vaporized nicotine solution refer may include an improvement in the smoothness of the vaporized nicotine solution as perceived by a user.

The process of the present invention may comprises additional steps either before the steps listed, after the steps listed or between one or more of the steps listed.

EXAMPLES

A series of tests were conducted using commercially available vibrating mesh nebulizer devices. The device was loaded with formulation containing 90.0% (w/w) water, 9.0% 2-hydroxy-propyl-β-cyclodextrin, 0.9% 1-menthol, and 0.1% nicotine.

The particles and vapor generated from the device was collected using two non-sintered impingers in series containing Isopropanol (IPA) solution and a 44 mm Cambridge Filter Pad (CFP). A single port smoking machine was used to deliver the aerosol from the device. The equipment was calibrated to an 80 mL puff volume using a bubble stick. The set up was also leak tested before use. Three replicates, of 30 puff each, on a single device were performed.

The device was weighed pre-and post-experiment to calculate the device mass loss (DML). The CFP's were weighed pre-and post-experiment to calculate the actual collected mass (ACM). The difference between the DML and the ACM was used to calculate the vapor phase.

The front CFP was used to capture the particles as it is 99.9% efficient at capturing particles larger than 0.1 micron in diameter [R. R Baker, Smoke Chemistry, ed. D. L. Davis and M. T. Neilson, Blackwell Science, Great Britain, 1999, ch. 12, p. 399]. The remaining vapor passed through the connectors and Nalgene tubing into the impingers. The front and back impingers were filled with 20 mL isopropanol (IPA).

The vapor and particle phases were analyzed separately. Each CFP were placed into 150 mL conical flasks. Following each test, three quarters of a CFP were used to collect any condensed aerosol on three additional sections of the CFP holder:

The front half of the CFP holder

The back half of the CFP holder

Behind the labyrinth seals 40 mL of IPA solution was then added to the conical flask. The content of both impingers was combined in a separate 150 mL conical flask to achieve the total volume of 40 mL. The conical flasks were then shaken on an orbital shaker set at 200 rotations per minute (RPM) for 20 minutes. The extracts were vialled in amber glass GC vials using glass Pasteur pipettes. The vials were sealed and analyzed by Agilent gas chromatograph coupled to mass spectrometer (GC-MS) equipped with a single quadrupole mass analyzer.

The GC-MS oven parameters were developed specifically for menthol. The flash point of menthol is between 91° C. and 92° C. and its retention time is approximately 13.86 minutes. It also has a run time of 16 minutes which was longer than the retention time of menthol which ensured all the menthol was volatilized.

Various modifications and variations of the present invention will be apparent to those skilled in the art without departing from the scope and spirit of the invention. Although the invention has been described in connection with specific preferred embodiments, it should be understood that the invention as claimed should not be unduly limited to such specific embodiments. Indeed, various modifications of the described modes for carrying out the invention which are obvious to those skilled in chemistry or related fields are intended to be within the scope of the following claims.

The invention claimed is:

1. An aerosolized formulation comprising a vapor phase and a liquid water droplet phase, wherein the aerosolized formulation comprises (i) water in an amount of at least 50 wt. % based on the aerosolized formulation; (ii) one or more flavors; (iii) nicotine; and (iv) an encapsulating material; wherein at least 50 wt. % of the one or more flavors is present in the vapor phase, and wherein an aerosol of the aerosolised formulation has the following particle size distribution: D10 of at least 0.5 μm.

2. The aerosolized formulation according to claim 1, wherein water is present in an amount of at least 75 wt. % based on the aerosolized formulation.

3. The aerosolized formulation according to claim 1, wherein water is present in an amount of at least 90 wt. % based on the aerosolized formulation.

4. The aerosolized formulation according to claim 1, wherein the one or more flavors are selected from the group consisting of (4-(para-) methoxyphenyl)-2-butanone, vanillin, γ-undecalactone, menthone, 5-propenyl guaethol, menthol, para-mentha-8-thiol-3-one and mixtures thereof.

5. The aerosolized formulation according to claim 4, wherein the one or more flavors comprises menthol.

6. The aerosolized formulation according to claim 1, wherein the one or more flavors are present in a total amount of no greater than 2 wt. % based on the aerosolized formulation.

7. The aerosolized formulation according to claim 1, wherein the one or more flavors are present in a total amount of from 0.01 to 1 wt. % based on the aerosolized formulation.

8. The aerosolized formulation according claim 1, wherein at least 70 wt. % of the one or more flavors is present in the vapor phase.

9. The aerosolized formulation according claim 1, wherein at least 90 wt. % of the one or more flavors is present in the vapor phase.

10. The aerosolized formulation according to claim 1, wherein at least 50 wt. % of the nicotine is present in the liquid water droplet phase.

11. The aerosolized formulation according claim 1, wherein at least 70 wt. % of the nicotine is present in the liquid water droplet phase.

12. The aerosolized formulation according to claim 1, wherein the encapsulating material comprises one or more cyclodextrins.

13. The aerosolized formulation according to claim 1, wherein encapsulating material is present in a total amount of at least 1 wt. % based on the aerosolized formulation.

14. The aerosolized formulation according to claim 1, wherein encapsulating material is present in a total amount of no greater than 12 wt. % based on the aerosolized formulation.

15. The aerosolized formulation according to claim 12, wherein the one more cyclodextrins are selected from the group consisting of substituted (α)-cyclodextrin, unsubstituted (α)-cyclodextrin, substituted (β)-cyclodextrin, unsubstituted (β)-cyclodextrin, substituted (γ)-cyclodextrin, unsubstituted (γ)-cyclodextrin, and mixtures thereof.

16. The aerosolized formulation according to claim 15, wherein the one more cyclodextrins comprises at least one substituted (β)-cyclodextrin.

17. The aerosolized formulation according to claim 1, wherein the nicotine is present in an amount of no greater than 1 wt. % based on the aerosolized formulation.

18. The aerosolized formulation according to claim 1, wherein the nicotine is present in an amount of from 0.01 to 0.6 wt. % based on the aerosolized formulation.

19. The aerosolized formulation according to claim 1, wherein the aerosolized formulation further comprises an acid.

20. The aerosolized formulation according to claim 19, wherein the acid is selected from the group consisting of acetic acid, lactic acid, formic acid, citric acid, benzoic acid, pyruvic acid, levulinic acid, succinic acid, tartaric acid, sorbic acid, propionic acid, phenylacetic acid, and mixtures thereof.

21. The aerosolized formulation according to claim 19, wherein the acid is selected from the group consisting of citric acid, benzoic acid, levulinic acid, sorbic acid, lactic acid, and mixtures thereof.

22. The aerosolized formulation according to claim 19, wherein the acid comprises citric acid.

23. The aerosolized formulation according to claim 12, wherein the aerosolizable formulation contains no flavors that can be encapsulated by the one or more cyclodextrins.

* * * * *